US010246312B2

(12) United States Patent
McClure

(10) Patent No.: US 10,246,312 B2
(45) Date of Patent: Apr. 2, 2019

(54) VEHICLE LIFT WITH SUPPORT ARMS

(71) Applicant: John McClure, Hillsboro, OH (US)

(72) Inventor: John McClure, Hillsboro, OH (US)

( * ) Notice: Subject to any disclaimer, the term of this patent is extended or adjusted under 35 U.S.C. 154(b) by 0 days.

(21) Appl. No.: 15/697,967

(22) Filed: Sep. 7, 2017

(65) Prior Publication Data

US 2018/0327235 A1 Nov. 15, 2018

Related U.S. Application Data

(60) Provisional application No. 62/506,021, filed on May 15, 2017.

(51) Int. Cl.

| | |
|---|---|
| ***B66F 3/25*** | (2006.01) |
| ***B66F 3/36*** | (2006.01) |
| ***B66F 3/24*** | (2006.01) |
| ***B66F 7/16*** | (2006.01) |

(52) U.S. Cl.

CPC ..... *B66F 3/36* (2013.01); *B66F 7/16* (2013.01); *B66F 3/245* (2013.01); *B66F 3/25* (2013.01)

(58) Field of Classification Search

CPC ..... B66F 7/28; B66F 7/26; B66F 5/00; B66F 5/02; B66F 13/00; B66F 7/10; B66F 7/16

See application file for complete search history.

(56) References Cited

U.S. PATENT DOCUMENTS

| | | | |
|---|---|---|---|
| 4,583,620 | A | 4/1986 | Bishop |
| 6,866,124 | B1 | 3/2005 | Barkis |
| 2012/0325587 | A1 | 12/2012 | Matthews et al. |
| 2013/0240696 | A1 * | 9/2013 | Black et al. |

FOREIGN PATENT DOCUMENTS

| | | | |
|---|---|---|---|
| DE | 2615074 | A1 * | 10/1977 |
| DE | 2654008 | A1 * | 6/1978 |
| EP | 1156009 | A1 | 11/2001 |
| GB | 2049618 | A * | 12/1980 |

OTHER PUBLICATIONS

English Machine Translation of DE 2654008.*

International Searching Authority, International Search Report and Written Opinion issued in related Application No. PCT/US2018/031731, dated Aug. 8, 2018, 11 pp.

* cited by examiner

*Primary Examiner* — Diem M Tran

(74) *Attorney, Agent, or Firm* — Wood Herron & Evans LLP

(57) ABSTRACT

A vehicle lift has lift arms pivoted to a central or to side lifts. A handle is pivoted to an extensible, retractable lift arm end and can be manipulated from outside the vehicle periphery to position the lift arm end in a desired alignment with lift points under the vehicle frame.

6 Claims, 7 Drawing Sheets

VEHICLE LIFT WITH SUPPORT ARMS

FIELD OF THE INVENTION

This invention relates to vehicle lifts and more particularly to the lift arms of such lifts and their adjustment to cooperate with lift points on a vehicle frame.

BACKGROUND OF THE INVENTION

Vehicle lifts generally are well known. One form of such lifts comprises a hydraulically cylindrical lift tube or piston having a head pivotally supporting a plurality of cantilevered swivel lift arms with telescopic ends adjustable to cooperate with lift points on the vehicle frame. U.S. Pat. No. 4,583,620 discloses such a lift and is herewith incorporated in its entirety by this reference. In use, the hydraulic piston and head are disposed directly, and more or less centrally, under a vehicle, with the arms extending outwardly for engagement of their respective ends with lift points or frames of vehicles.

Another form of such lifts comprises two lift columns oppositely disposed outside the perimeter of the vehicle. Each column supports two pivotable, telescoping lift arms which extend from the columns under the vehicle and with ends engaging lift points in a vehicle frame. U.S. Pat. No. 6,866,124 discloses such a lift and is herewith incorporated in its entirety by reference.

In both forms of lifts, the lift arms must be angularly and linearly adjustable so their ends respectively lie beneath predetermined lift points on a vehicle frame. When the respective lift columns are activated, the positioned lift arms rise and engage the vehicle to lift it.

If the lift arms are not properly positioned, they may engage undesirable or non-structural elements of the vehicle or vehicle frame, resulting in damage to the vehicle, or in unstable lifting, the results being potentially catastrophic should the lifted vehicle shift on or fall from the lift.

Since the lift arms extend under the vehicle in any such form of lift, an operator must typically get down on the floor of the garage or facility, reach under the vehicle to the lift arm, and both pivot and telescope the arm so the respective arm end aligns with a lift point on the vehicle frame. Frequently, the lift is then raised slightly with the operator then getting down to check the alignment before the lift engages the vehicle.

With the lift arms disposed under the vehicle to be lifted (within the outer periphery of the vehicle), the lift arms are difficult for an operator to reach, and to move or adjust pivotally and linearly. Typically an operator is thus required to lie on the facility floor or on a wheeled support to get far enough under the vehicle for such adjustment.

Accordingly, it is an objective of this invention to provide apparatus for facilitating adjustment of the lift arms of a vehicle lift without the prior operator having to move far under or beneath the vehicle.

A further objective of the invention is to provide adjustment apparatus for the lift arms of a vehicle lift.

A further objective of the invention is to facilitate proper placement of the lift arms of a lift under a vehicle to be lifted.

SUMMARY OF THE INVENTION

To these ends, a preferred embodiment of the invention comprises lift arm adjusters in the form of rods or handles pivoted to proximate extensible distal ends of each lift arm. Once the lift arms are positioned under the vehicle, the adjusters can be operated from a position near or outside the vehicle periphery to rotate, or extend, or both, the arm ends to proper position under the vehicle. Positioning of the lift arms and lift arm ends is accomplished by an operator who can remain outside the periphery of the vehicle, and not under the vehicle, prior to its lifting.

BRIEF DESCRIPTION OF THE DRAWINGS

These and other details and alternatives will be appreciated from the following matter description and from the drawings in which.

DETAILED DESCRIPTION OF THE INVENTION

The Figures illustrate the invention in use with a lift arm pivoted to a vertical lift hoist member or apparatus comprising in one application a lift column of the type used in conjunction with another opposite vertical lift member on an opposite side of a vehicle. It will be appreciated that the invention is useful in conjunction with each lift arm of a central column hoist or of two side column hoists, one side column being shown here for illustration.

Figure 1:
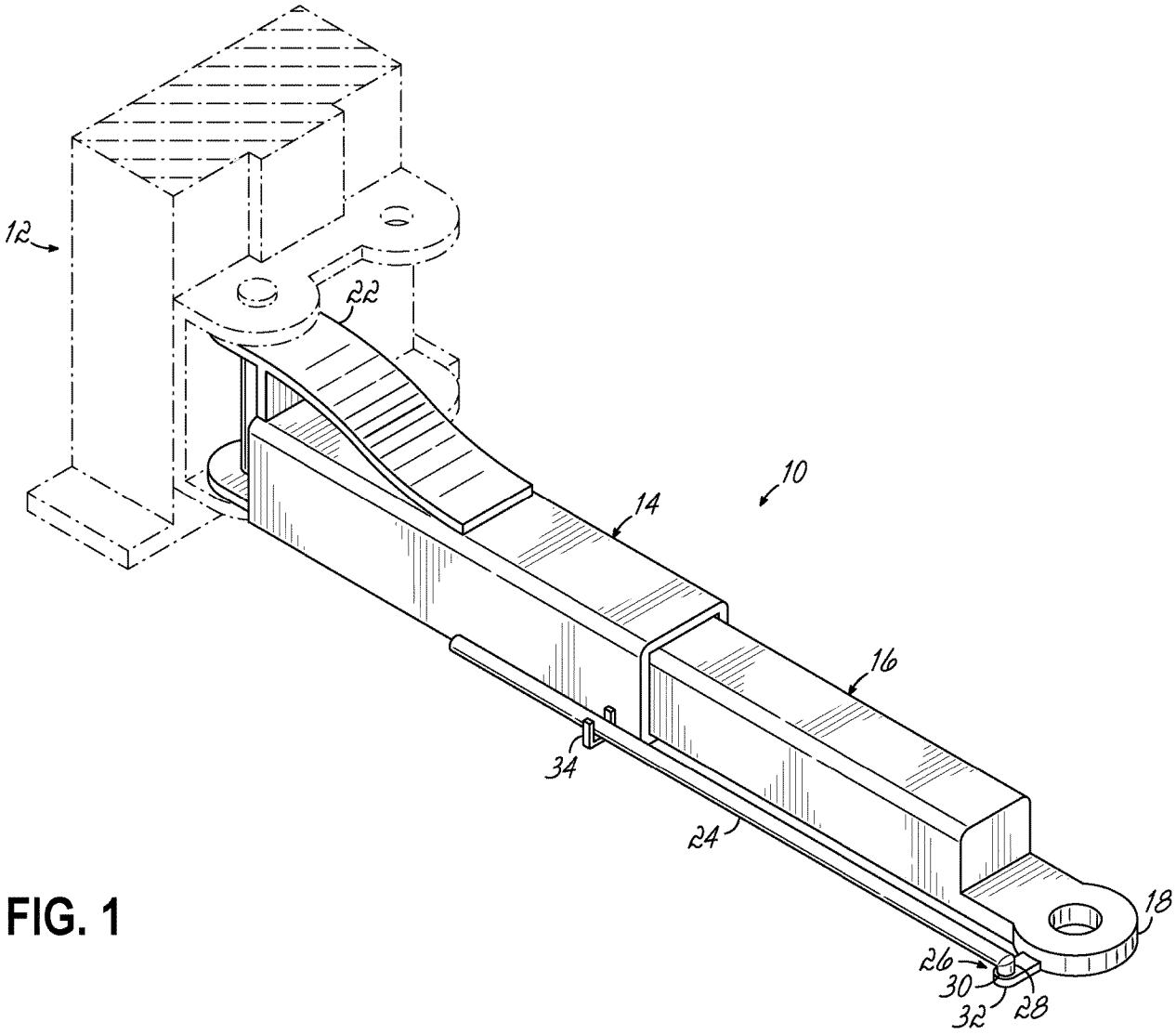
FIG. 1 is an isometric illustration of one embodiment of the invention showing an adjuster rod pivoted near the distal end of one lift arm which is pivoted to one lift column of a two-column lift.

In FIG. 1, a lift arm 10 is pivoted for lifting to a lift column hoisting device 12 of any suitable construction for positioning at one side of a vehicle (not shown here) to lift a vehicle in conjunction with a lift column hoist and respective lift arms extending under a vehicle from the other side.

Lift arm 10 includes an extended hollow tube 14 and a telescoping inner arm 16, slidable within tube 14.

Figure 2:
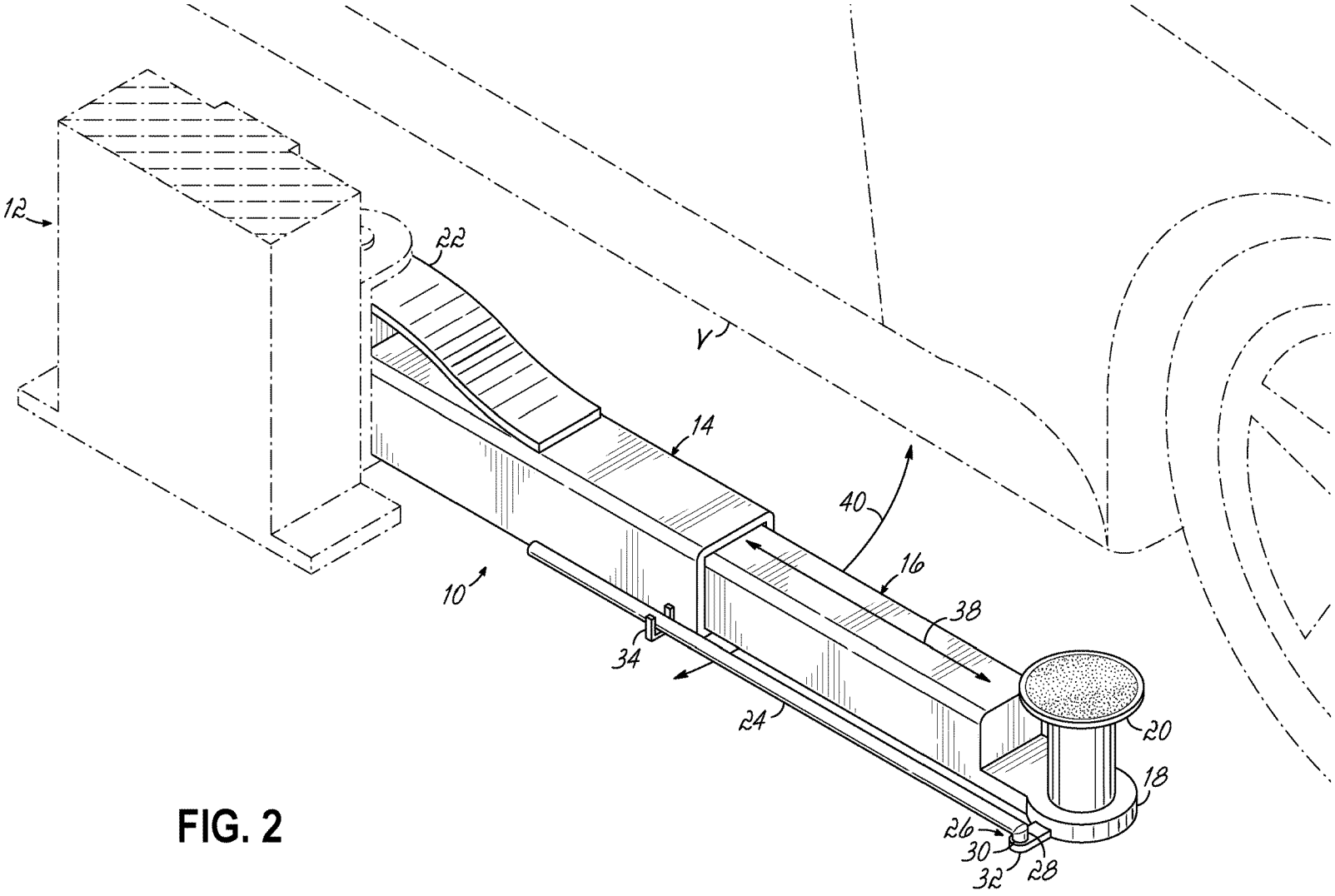
FIG. 2 is an isometric illustration similar to FIG. 1 but further illustrating the lift arm, lift column and adjusting rod beside a vehicle.
Figure 3:
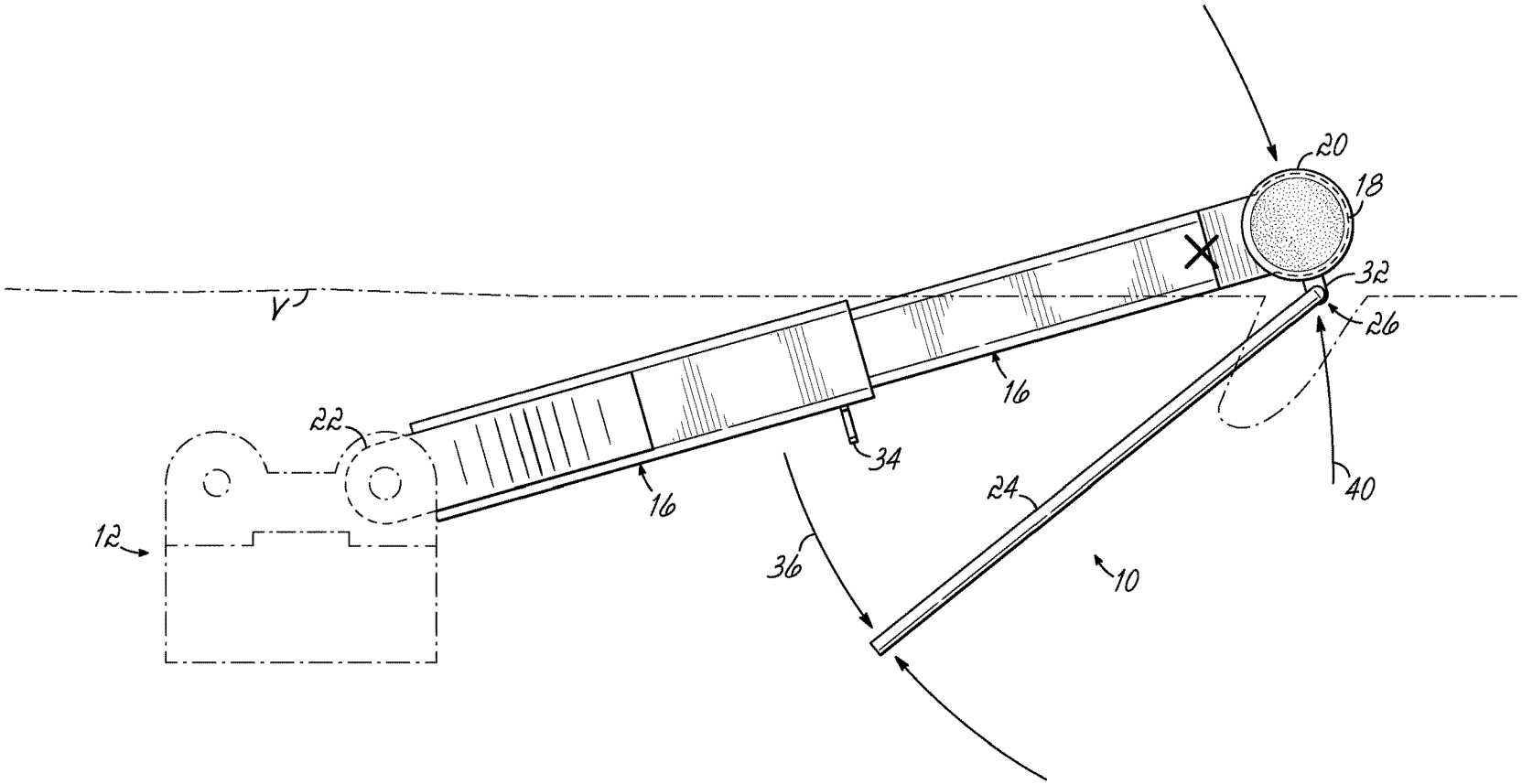
FIG. 3 is an isometric illustration of manual operation of the lift arm of FIGS. 1 and 2 extended beyond a lift point X on the vehicle.
Figure 4:
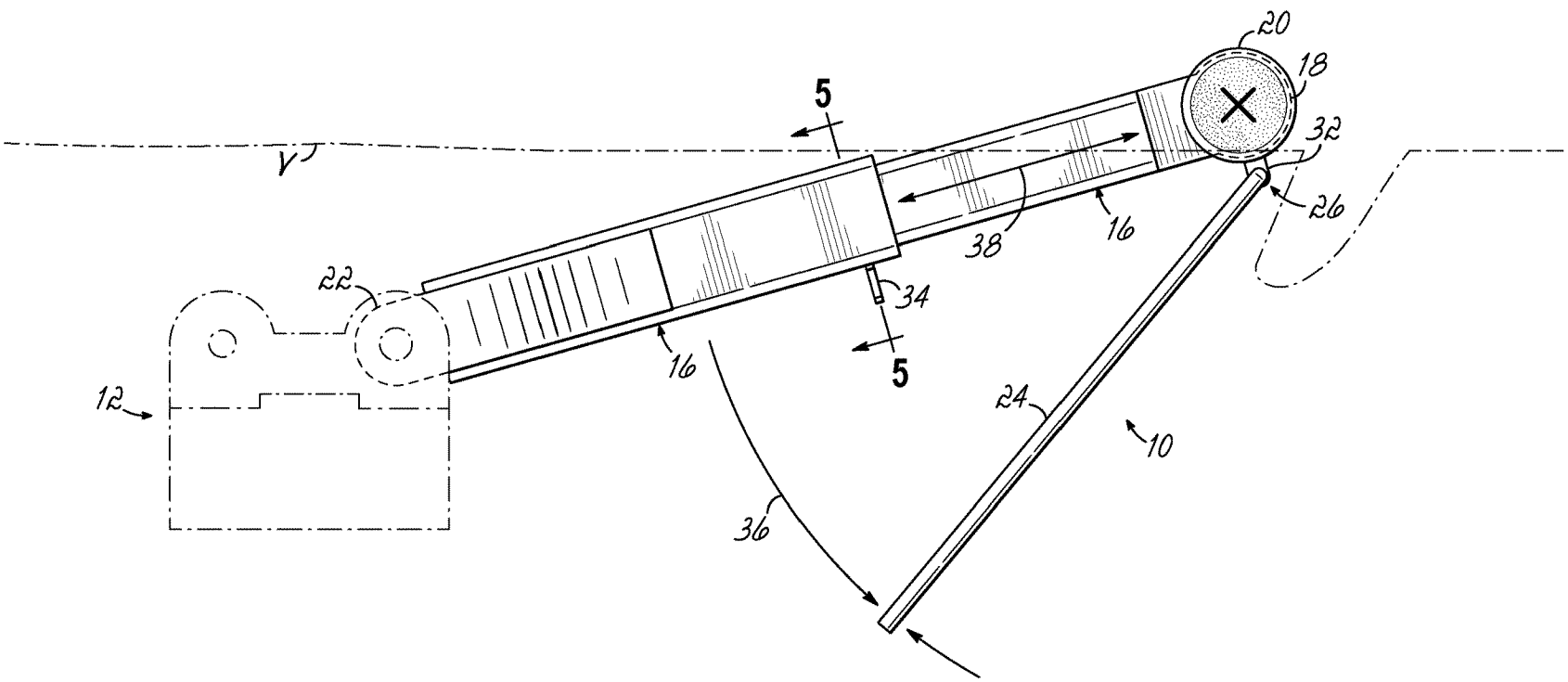
FIG. 4 is an isometric illustration as in FIG. 3 further illustrating lift arm adjustment under a vehicle back to lift point X.

Telescoping inner arm 16 has a distal end 18 structured to receive an attachable lift pad 20 (FIGS. 2-4).

Arm tube 14 has a rear end 22 operably pivoted to lift column hoist 12.

In accordance with the invention, a handle, in this case an extended rod 24, is pivoted to arm 16 proximate end 18, and at pivot point 26. This pivot structure may take the form of a 90° bend 28 in rod 24 extending downwardly through hole 30 in a tab 32, extending from end 18 of arm 16.

Figure 7:
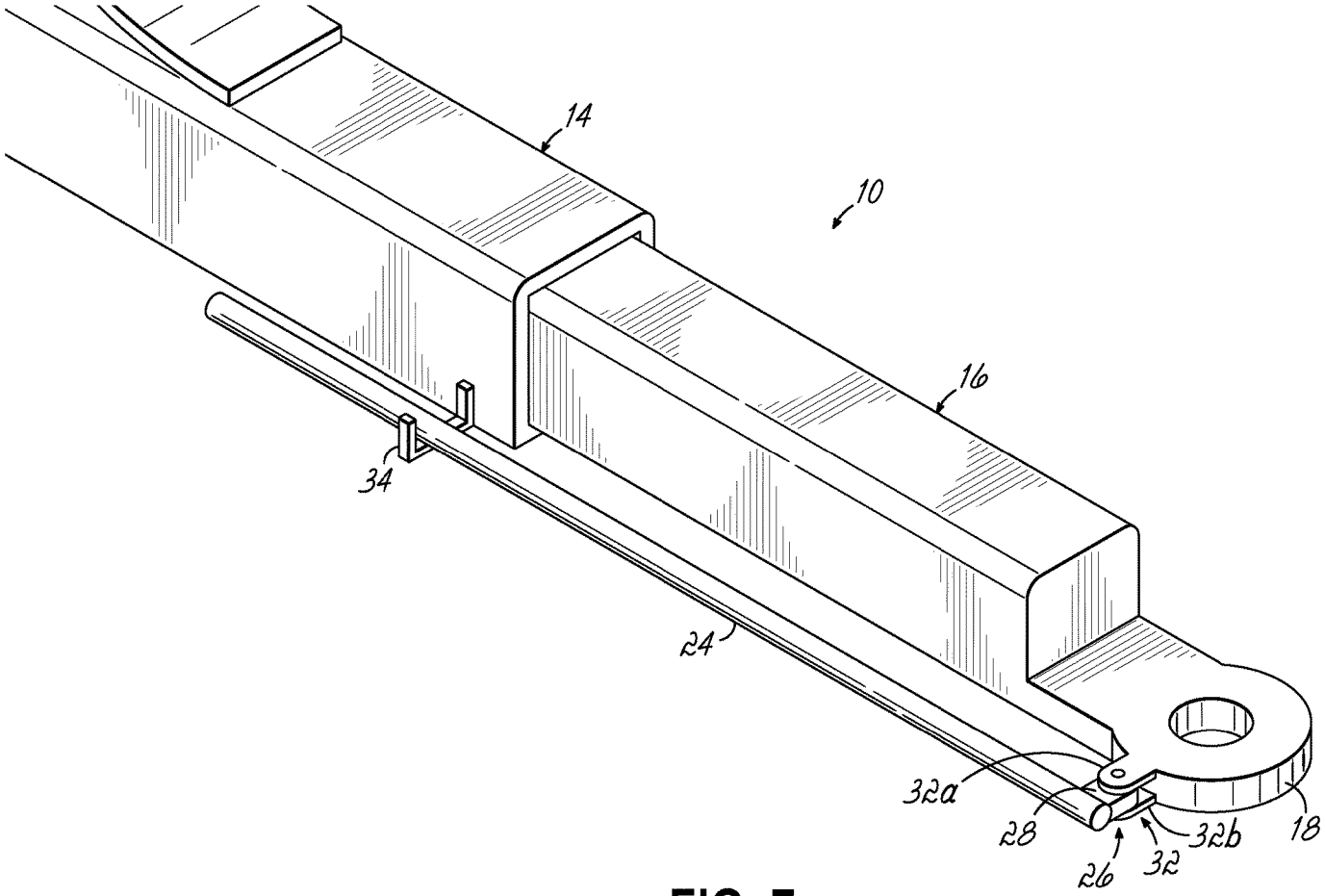
FIG. 7 is an isometric view of the invention as in FIG. 1.

Tab 32 may comprise two elements 32*a*, 32*b* (FIG. 7) in a stirrup or U-shaped extension, extending from distal arm end 18 with an end of rod 24 between the tabs 32*a*, 32*b* and pivoted thereto by bolts, fasteners or the bend 28 thereby in any suitable configuration, it only being significant that rod 24 is pivoted to distal end 18 of arm 16.

A bracket 34 (see FIGS. 6 and 8) is mounted on an arm 10 such as on arm tube 14. An end of rod 24 resides and is secured in this bracket 34 when not in use.

Figure 6:
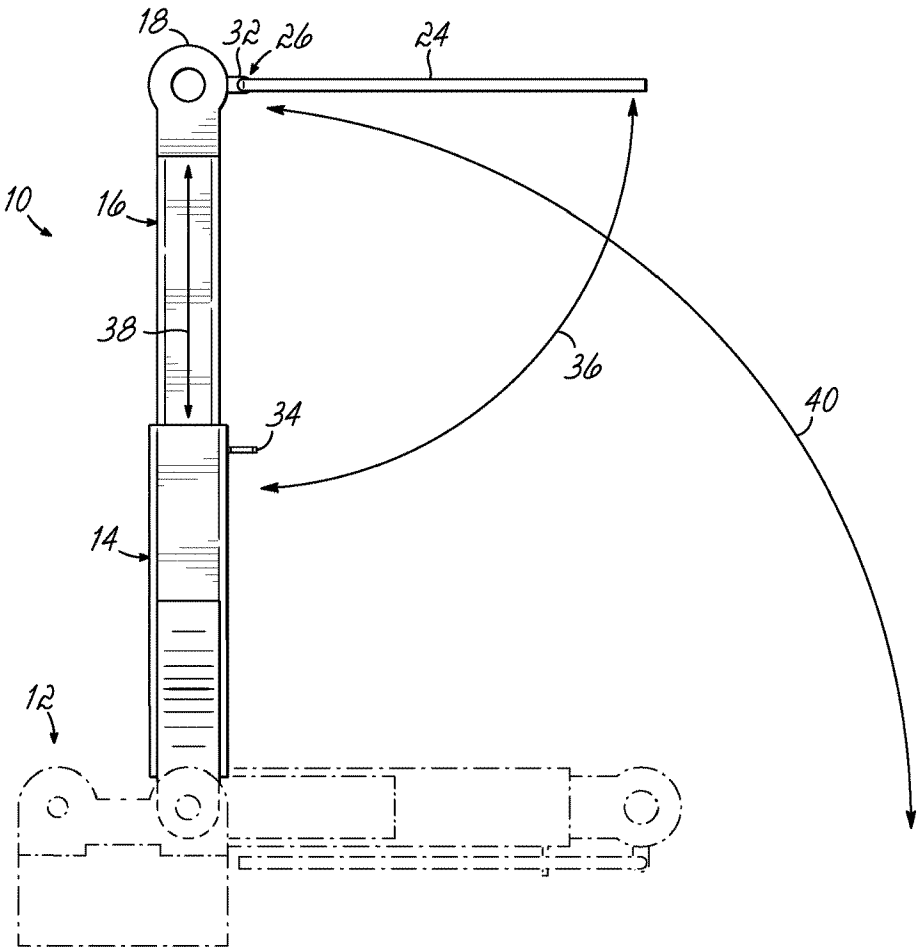
FIG. 6 is a top plan isometric view of the invention further illustrating adjustment movements of the lift arm and handle.
Figure 5:
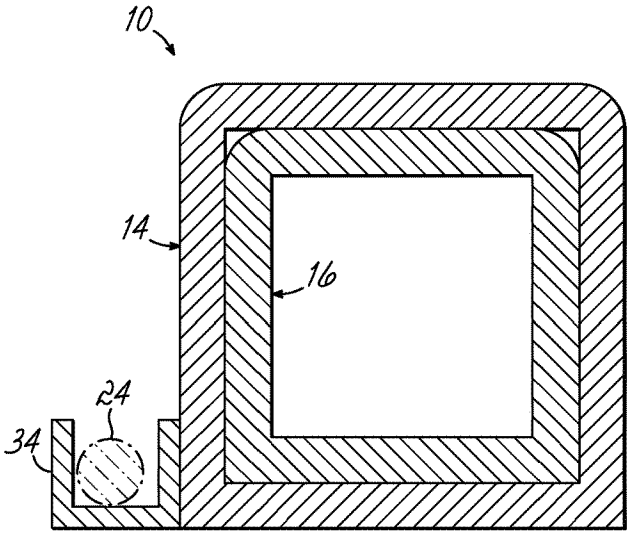
FIG. 5 is a cross-sectional view of the invention taken along lines 5-5 of FIG. 4.

As illustrated in FIGS. 3, 4 and 6, rod 24 is moveable through arc 36 with respect to distal end 18, and about the pivot at tab 32, when the rod is removed from bracket 34. Arm 10 is moveable in an arc 40.

Also, it will be appreciated that arm 10 is manually extendible and retractable (see elements 14, 16) in the linear direction of arrow 38, in a radial direction from its pivot to lift column hoist 12. Also arm 10 is rotatable through arc 40 about its pivot at arm end 22 to the lift column hoist 12.

The rotation and extension of arm 10 and its components 14, 16 is maneuvered, by manually holding and manipulating rod 24, in these arcuate and linear motions or directions, and from a position exterior of the perimeter of the vehicle.

Figure 8:
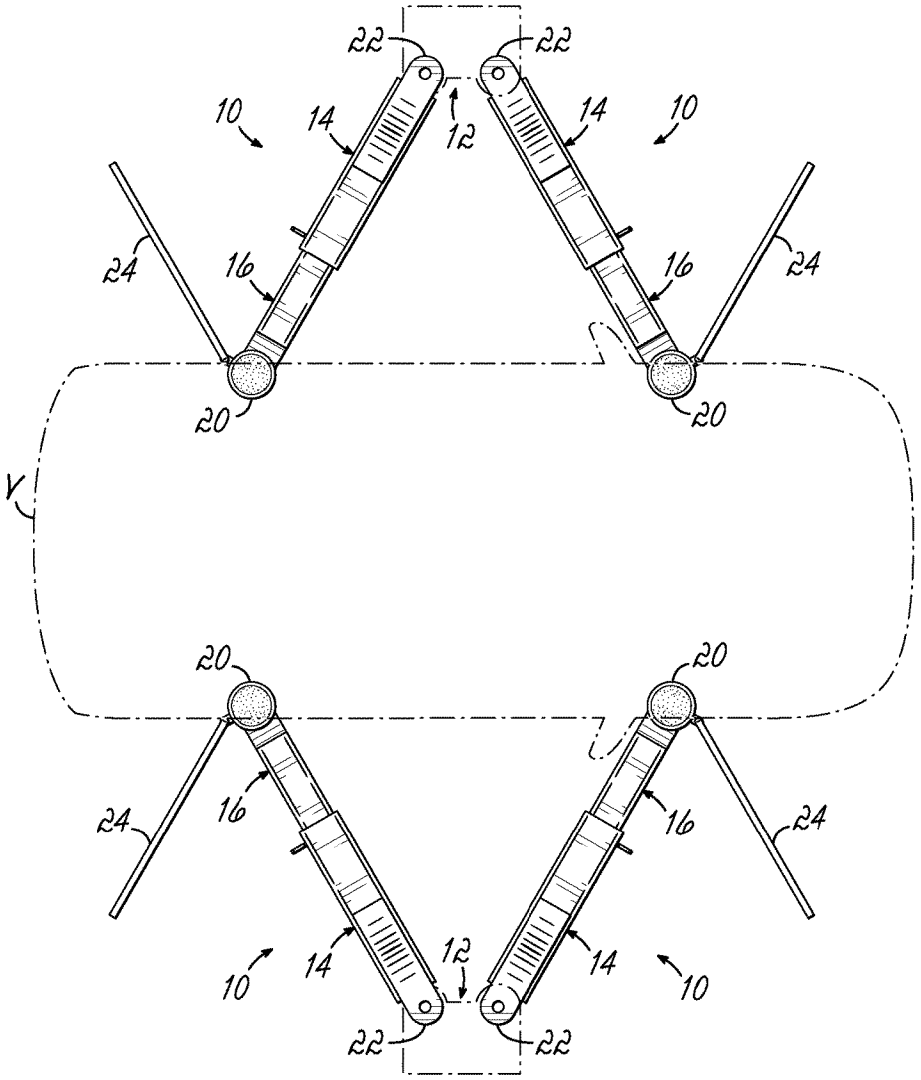
FIG. 8 is a top plan isometric view of the invention of FIG. 1 applied in side lift hoists under a vehicle.

As seen in FIGS. 2-4 and 8, a vehicle "V" is in location with one side thereof near lift column hoist 12. In FIG. 2, arm 10 lies generally parallel to vehicle V allowing the vehicle to be moved into position between lift column hoist 12 and a preferably like hoist on an opposite side of vehicle V. In FIGS. 3, 4 and 8 arm 10 is moved toward and under vehicle V in an arc 40 by manipulation of rod 24 to extend or retract arm component 16 so that lift pad 20 can be moved toward and under the vehicle to align with a vehicle frame lift point X.

Thus arm 10 is maneuvered under the vehicle by rod 24 such that the operator himself need not move any human body part under the vehicle, inside the outer periphery thereof, the rod 24 preferably (but not necessarily) being long enough to enable lift arm placement under the vehicle without the operator's hand or arm extending thereunder, and without the operation lying on the ground.

The same operation is performed with the opposite side lift column and its arms.

In an alternative comprising a central column lift environment, the arm handles such as rod 24 are extended forwardly from the extensible and rotatable arms 10 to a position outside the periphery of a vehicle disposed over the central column lift for grasping from the sides of the vehicle on the lift and positioning the respective arms.

Operation of the invention is graphically illustrated in FIG. 8 wherein a side lift hoist 12 is outfitted with two lift arms 10, each pivoted at respective ends 22 to a hoist 12. A hoist 12 is disposed on each opposite side of a vehicle V and outside of the vehicle periphery P. Each arm 10 is pivoted and extensible or retractable under a vehicle V by an operator manipulating arms 10 through handles 24 from outside of periphery P, as noted above.

It will be appreciated that while the invention herein has been described in application with a "two stage" lift where the lift arm 10 has two components including hollow tube 14 and telescoping inner arm 16, the invention is also applicable to a composite lift arm having three or more components.

For example, an intermediate hollow tube, slidable within hollow tube 14, can be provided, with inner arm 16 slidable within that intermediate arm, and so on. For such a case, the multiple component lift arm such as arm 10, but with three or more components can have even greater reach, with handle rod 24 either being extended in length or having an extensible member itself to accommodate extension of the handle rod 24 and collapsible or extensible to rest in bracket 34 upon extension or retraction of the multiple component lift arm.

These and other alternatives and advantages will become readily apparent to those of ordinary skill in the art without departing from the scope of the invention, and applicant intends to be bound only by the claims appended hereto.

What is claimed is:

1. An adjustable vehicle lift comprising:

at least one lift arm pivotally extending away from a vertical hoist to a distal arm end for engaging a vehicle to be lifted;

said arm being extensible;

an extended handle pivotally attached to said arm proximate said distal end, said handle being operable by an operator to pivot and extend said arm, beneath the vehicle, from an operator position outside a periphery of the vehicle.

2. An adjustable vehicle lift as in claim 1 wherein said arm includes an arm tube and a telescoping inner arm tube extensibly and retractably moveable within said arm tube, said telescoping inner arm having said distal arm end thereon.

3. An adjustable vehicle lift as in claim 2 further including a lift pad mounted onto said distal arm end.

4. An adjustable vehicle lift as in claim 1 wherein said extendable handle is moveable in an arc radially about said distal end.

5. An adjustable vehicle lift as in claim 4 wherein said lift arm is moveable in an arc about said vertical hoist.

6. An adjustable vehicle lift as in claim 1 wherein when used with a vehicle having an outer periphery, said vertical hoist is disposed outside said periphery and said extended handle is operable to move said distal arm end beneath and under said vehicle from a position outside said periphery.

* * * * *